United States Patent [19]

Vytlacil

[11] Patent Number: 4,859,294

[45] Date of Patent: Aug. 22, 1989

[54] PROCESS FOR ELECTROCHEMICALLY OXIDIZING SULPHURIC ACID CHROMIUM-III-SOLUTIONS TO CHROMIUM-VI-SOLUTIONS

[76] Inventor: Richard Vytlacil, Donaustrasse 110/10, 2346 Maria Enzersdorf/Südstadt, Austria

[21] Appl. No.: 85,677

[22] PCT Filed: Feb. 27, 1986

[86] PCT No.: PCT/AT86/00016

§ 371 Date: Jul. 24, 1987

§ 102(e) Date: Jul. 24, 1987

[87] PCT Pub. No.: WO86/05215

PCT Pub. Date: Sep. 12, 1986

[30] Foreign Application Priority Data

Feb. 27, 1985 [AT] Austria ..... 577/85

[51] Int. Cl.[4] ..... C25B 1/00

[52] U.S. Cl. ..... 204/97

[58] Field of Search ..... 204/97, 130

[56] References Cited

U.S. PATENT DOCUMENTS 1,739,107 12/1929 Udy ..... 204/97

4,273,628 6/1981 Kidon et al. ..... 204/87

*Primary Examiner*—John F. Niebling

*Assistant Examiner*—Steven P. Marquis

[57] ABSTRACT

The processing of nitric acid-containing, sulphuric acid chromium-III-solutions as obtained during oxidative purification of flue gases meets with great difficulties as well as enormous costs. It is the object of the invention to provide a process having low current costs for the electrolysis. The inventive process for electrochemically oxidizing sulphuric acid chromium-III-solutions to chromium-VI-solutions essentially comprises an electrolyte which contains nitric acid, sulphuric acid and chromium. In such electrolyte the nitric acid is utilized as a redox carrier for the oxygen electrode which serves as the cathode, and the nitric acid is regenerated using the oxygen. Carbon or graphite is used as the cathode material. As the anode material there are used electrodes having high oxygen overvoltage such as, for example, lead dioxide. The cell voltages which can be attained under these conditions, lie in the range of 0.9 to 2 volt. This means that the current costs for the electrolysis are reduced to about one third.

5 Claims, No Drawings

PROCESS FOR ELECTROCHEMICALLY OXIDIZING SULPHURIC ACID CHROMIUM-III-SOLUTIONS TO CHROMIUM-VI-SOLUTIONS

The invention relates to a process for electrochemically oxidizing sulphuric acid chromium-III-solutions to chromium-VI-solutions.

The processing of nitric acid-containing, sulphuric acid chromium-III-solutions obtained during the oxidative purification of flue gases, cause great difficulties. Thus, when nitric acid remains in the electrolyte during processing of the oxidizing agent, up to 30% ammonium ions in addition to hydrogen are formed at the cathode in the presence of chromium-III-ions. The removal of these ammonium salts is only possible using complicated methods.

When the nitric acid is completely removed from the system, then the hydrogen generation remains as the cathode reaction; however, during this process there exists the danger that chromium is deposited at the cathode from the sulphuric acid solution and such chromium must be re-added to the solution.

The cell voltages which can be attained in practice using this arrangement, lie between 4.8 and 6.4 volt and can still be further increased due to the poorer conductivity of chromium coated cathodes.

It is the object of the invention to provide a process of the initially mentioned type which, on the one hand, avoids the disadvantages of the known processes and during which, on the other hand, the current costs for the electrolysis are reduced.

The inventive process is characterized in that there are contained in the electrolyte nitric acid, sulphuric acid and chromium. The nitric acid functions as a redox carrier for the oxygen electrode which serves as the cathode. The nitric acid is regenerated by infeeding oxygen or air into the electrolyte which is present in the cathode space.

Due to replacing the hydrogen electrode with an electrode reaction at significantly more positive electrode potential, the process according to the invention permits significantly reducing the current costs during electrolysis.

The cathodic oxygen reduction offers itself as the most positive cathode reaction. However, the reduction of oxygen in acidic solutions is kinetically strongly inhibited. Useful oxygen electrodes in an acid medium require either expensive catalysts on the basis of precious metals or suitable redox carriers. The reduced species formed from the redox carrier must have high reactivity such that the reduced species can be reoxidized by the oxygen which is dissolved in the electrolyte. The reduction of nitric acid has been selected as the cathode reaction for the inventive process since the reversible potential for the nitric acid reduction amounts to +940 millivolt and thus is close to the reversible potential of the oxygen electrode. The cell voltages which can be attained under these conditions lie between 0.9 volt and about 2 volt. This means that the current costs for the electrolysis can be reduced to about one third.

Further advantages reside in the fact that during processes during which solely nitrose gases are oxidized to nitric acid, the complicated quantitative removal of nitric acid from the chromo-sulphuric acid is eliminated and that under the reaction conditions, i.e. at potentials more positive than +840 millivolt versus the normal hydrogen electrode, the nitric acid cannot be reduced up to ammonia.

According to a specific feature of the invention, the electrolysis is preferably carried out using an electrolyte composition of 20 g/l to 300 g/l sulphuric acid, 20 g/l to 200 g/l nitric acid and 20 g/l to 30 g/l chromium.

According to a further feature of the invention, activated coal and/or graphite are preferably utilized as the cathode material.

According to one design of the invention there are used as the anode material, electrodes having high oxygen overvoltage such as, for example, lead dioxide, manganese dioxide, tin dioxide and/or combinations thereof.

The electrolysis cell comprises the conventional arrangement of a plural number of series connected anode and cathode spaces which are separated by respective diaphragms. In such arrangement the anodes and cathodes operate as bipolar electrodes. The electrolyte is infed into the individual cathode spaces through respective infeed conduits and, thereafter, is supplied to the anode spaces and removed through a collective conduit. Air and/or oxygen is infed, for example, through perforated tubes which are arranged at the bottom in the cathode spaces.

The exiting excessive gases are withdrawn and recycled into the cells. Any used-up oxygen is continuously replaced.

For the cathodes, there are used either porous gas diffusion electrodes made of activated coal or graphite or agitated electrodes which are made of the same material. The used-up residual gas containing traces of nitrogen oxides which can be formed as intermediate products during the cathode reaction and which are entrained into the gas flow, is recycled into the oxidative flue gas scrubbing installation.

What I claim is:

1. Process for electrochemically oxidizing sulphuric acid chromium-III-solutions to chromium-VI-solutions in a cell which is subdivided by means of a diaphragm, and with the infeeding of air into the electrolyte which is present in the cathode space, characterized in that the electrolyte contains nitric acid, sulphuric acid and chromium-III and the nitric acid is used as a redox carrier for the oxygen electrode which is used as the cathode, and that the nitric acid is regenerated by infeeding oxygen or air.

2. Process according to claim 1, characterized in that the electrolysis is carried out using an electrolyte composition containing sulphuric acid in a concentration in the range of 20 g/l to 300 g/l, nitric acid in a concentration in the range of 20 g/l to 200 g/l and chromium in a concentration in the range of 20 g/l to 30 g/l.

3. Process according to claim 1 or 2, characterized in that activated coal and/or graphite are employed as the cathode material.

4. Process according to claim 1 characterized in that electrodes having high oxygen overvoltage are used as the anode.

5. Process according to claim 4, characterized in that the electrodes having said high oxygen overvoltage, are selected from the group consisting of lead dioxide, manganese dioxide, tin dioxide or a combination thereof.

* * * * *